US006595268B1

(12) United States Patent
Schmitz

(10) Patent No.: US 6,595,268 B1
(45) Date of Patent: Jul. 22, 2003

(54) SPIN CAST END CAP ASSEMBLY WITH INTERNAL FLYWEIGHTS

(75) Inventor: Joseph Paul Schmitz, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/515,636

(22) Filed: Feb. 29, 2000

(51) Int. Cl.[7] ..... B22D 13/04
(52) U.S. Cl. ..... 164/286; 164/292; 164/293
(58) Field of Search ..... 164/286, 287, 164/298, 299, 293, 292, 300

(56) References Cited

U.S. PATENT DOCUMENTS

| | | | | |
|---|---|---|---|---|
| 1,485,860 A | 3/1924 | Ladd | | |
| 1,486,544 A | 3/1924 | Rathbone | | |
| 1,489,036 A | 4/1924 | Ladd | | |
| 1,583,576 A | 5/1926 | Coburn | | |
| 2,267,010 A | 12/1941 | Anderson | 22/65.1 | |
| 2,370,953 A | 3/1945 | Greenberg | 22/65 | |
| 3,004,314 A | 10/1961 | Beyer | 22/200.5 | |
| 4,901,782 A | 2/1990 | Kazuhiro | 164/293 | |

FOREIGN PATENT DOCUMENTS

| | | | |
|---|---|---|---|
| DE | 767244 | | 5/1952 |
| GB | 2265098 A | * | 3/1992 |
| JP | 57127565 | | 8/1982 |

OTHER PUBLICATIONS

"Carousel Spinner", Dana Corp., 1994.
"JD Locking Ring", Deere & Company, (date unknown).

* cited by examiner

*Primary Examiner*—M. Alexandra Elve
*Assistant Examiner*—Len Tran

(57) ABSTRACT

A spin cast die assembly includes a casing, an insert and an end cap assembly for retaining the insert against an annular shoulder within the casing. The end cap assembly has a mounting ring attached an end of the casing. The mounting ring receives a flyweight ring which engages an end of the insert and which pivotally supports a plurality of flyweight members which are mounted radially internally with respect to the mounting ring. The mounting ring has an annular flyweight engagement surface which faces generally radially inwardly and towards the shoulder. As the assembly is spun, the inner ends of the flyweight members pivot radially outwardly. The flyweight members thereby cooperate with the flyweight engagement surfaces of the mounting ring to cause the flyweight ring to move axially towards the insert and thereby force the insert against the shoulder.

16 Claims, 2 Drawing Sheets

SPIN CAST END CAP ASSEMBLY WITH INTERNAL FLYWEIGHTS

BACKGROUND OF THE INVENTION

The invention relates to spin casting die assemblies, and more particularly, to end caps for spin cast die assemblies which have inserts which must be axially retained during the spin casting process.

There are known spin cast die assemblies which have a hollow cylindrical outer housing or casing in which a hollow cylindrical insert is inserted. Such an insert must be retained within the casing and held axially against an annular shoulder in the casing. To maintain the insert against the casing shoulder end cap assemblies have been attached to the end of the casing. One type of end cap assembly, which has been in use for around 50 years, includes a locking ring with exterior ramped flanges and an outer cap which is bolted onto to the end of the casing. The outer cap has cam surfaces which cooperate with the flanges to cause the locking ring to move axially inwardly to clamp the insert in place as the locking ring is rotated. To rotate the ring into and out of position requires an unpowered manually operated steering wheel unit (for small die assemblies) or hydraulically operated hammering/ratcheting mechanism (for large die assemblies), and the locking ring must be capable of withstanding high temperatures. The locking rings have to be replaced often as a result of being hammered into and out of place.

Another type of end cap is bolted onto the end of the casing and includes external flyweights. As the assembly is spun, the flyweights pivot and urge an inner ring axially inwardly towards the insert. But, such external flyweights can interfere with the spin cast die assemblies being rolled from one location to another, and can prevent such an assembly from being used in a spinner cabinet.

SUMMARY OF THE INVENTION

Accordingly, an object of this invention is to provide a spin cast die assembly with an end cap mechanism which does not have to be hydraulically hammered into and out of place.

A further object of the invention is to provide such a spin cast die assembly with an end cap mechanism which can withstand high temperatures.

Another object of the invention is to provide such a spin cast die assembly with an end cap mechanism which does not have external parts, such as flyweights, which interfere with movement of the spin cast die assemblies or which prevent use of the assembly in spinner cabinet.

These and other objects are achieved by the present invention, wherein a spin cast die assembly includes a casing, an insert and an end cap assembly for retaining the insert against an annular shoulder within the casing. The end cap assembly has a mounting ring attached to an end of the casing. The mounting ring receives a flyweight ring which engages an end of the insert and which pivotally supports a plurality of flyweight members which are mounted radially internally with respect to the mounting ring. The mounting ring has an annular flyweight engagement surface which faces generally radially inwardly and towards the shoulder. As the assembly is spun, the inner ends of the flyweight members pivot radially outwardly. The flyweight members thereby cooperate with the flyweight engagement surfaces of the mounting ring to cause the flyweight rings to move axially towards the insert and thereby force the insert against the shoulder.

DETAILED DESCRIPTION

Figure 1:
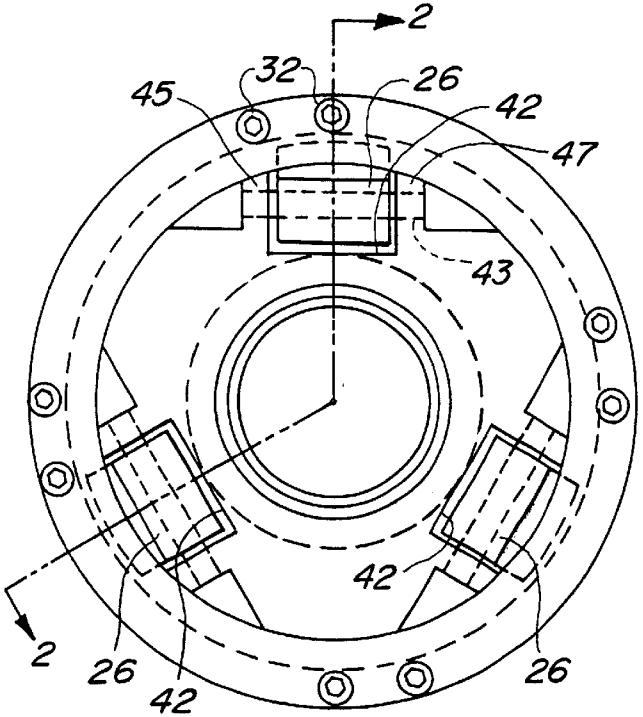
FIG. 1 is an end view of an end cap assembly according to the present invention.
Figure 2:
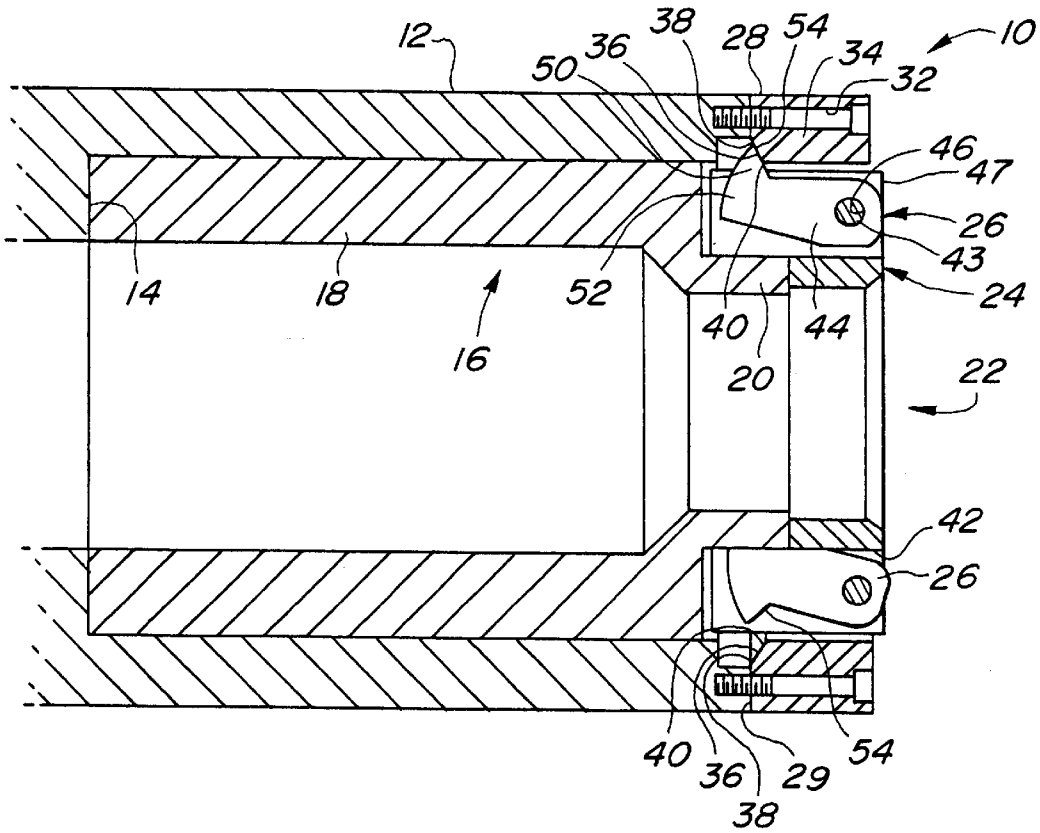
FIG. 2 is a sectional view along lines 2—2 of FIG. 1.

Referring to FIGS. 1 and 2, a spin cast die assembly 10 includes a hollow cylindrical outer housing or casing 12 which forms an interior, annular, axially facing shoulder 14. A hollow cylindrical insert 16 is inserted into the casing 12. The insert 16 has a larger diameter main body 18 and a smaller diameter neck 20. An end cap assembly 22 includes a hollow cylindrical flyweight member or inner ring 24, to which are pivotally mounted a plurality, preferably three, flyweight members 26, and a mounting member or ring 28. The mounting ring 28 has an inner end 29 which abuts against the casing 12 when the mounting ring 28 is attached to the end of the casing 12 by a plurality of bolts (not shown) which extend through axially extending bolt holes 32. The mounting ring 28 receives the flyweight ring 24, and the ring 24 engages an end of the insert 16. The mounting ring 28 has a hollow cylindrical body 34 which forms an annular flyweight engagement surface 36. As seen on edge in FIG. 2, the surface 36 is frustoconical, faces generally radially inwardly and axially towards the inner end 29 and towards the shoulder 14, and extends from an outer edge 38 radially inwardly and axially away from the shoulder 14 to an inner edge 40.

The ring 24 has a plurality, (preferably three) three cutout portions or slots 42, each of which receives a corresponding flyweight member 26. Each flyweight 26 is located radially internally with respect to the mounting ring 28, and has a main body 44 with a mounting bore 46 at its axially outer end 48. Each flyweight 26 is pivotally supported on a pin 43 which extends through the mounting bore 46 and which is supported by pin supports 45 and 47 on opposite sides of the flyweight member 26. Each flyweight 26 has an arm 50 which projects generally radially outwardly from the axially inner end 52 of body 44. A ring engagement surface 54 is formed on the arm 50 for engaging the flyweight engagement surface 36. As seen on edge in FIG. 2, the surface 54 faces generally radially outwardly and away from the shoulder 14.

Preferably, the flyweight support ring 24 should meet the end of the insert 16 to form an entrance tube to the center of the die assembly 10 so that no liquid metal can splash into a loose seam and build up over time. The inner end of the flyweight support ring 24 should loosely surround, (not necessarily completely) the neck 20 of the insert 16, in order to maintain the alignment of the endcap assembly 22.

As the assembly 22 is spun, the flyweight members 26 pivot radially outwardly. The ring engagement surfaces 54 slidably engage the flyweight engagement surface 36, and this causes the flyweights 26 and the ring 24 to move axially inwardly towards the insert 16 and thereby forces or holds the insert against the shoulder 14.

This end cap assembly 22 does not have to be hydraulically hammered into and out of place and it can withstand high temperatures. Also, the flyweights 26 do not project radially outwardly from the assembly, and therefore, they do not interfere with movement of the spin cast die assemblies 10 and do not prevent use of the assembly 10 in a spinner cabinet.

Figure 3:
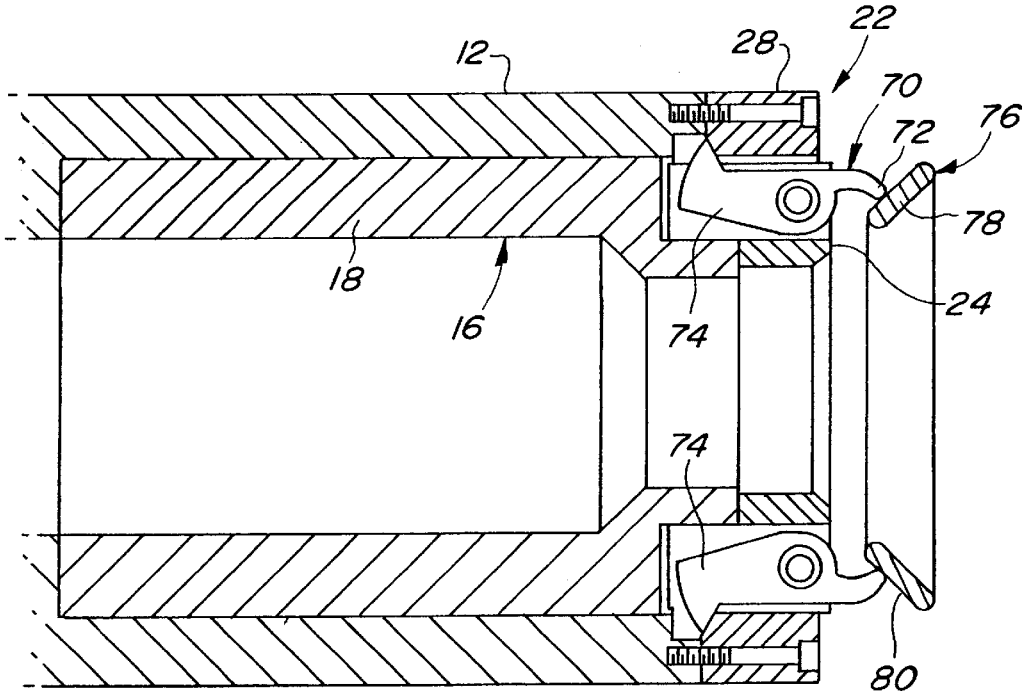
FIG. 3 is a partial sectional view of an alternate embodiment of an end cap assembly together with an insertion and removal tool.

An alternative embodiment is shown in FIG. 3, wherein each flyweight member 70 includes a tool engaging portion for engaging a tool 76, and each flyweight member 70 cooperates with the tool 76 to pivot out of engagement with the mounting ring 28 as the tool 76 is moved towards the insert 16. Preferably, each flyweight member 70 includes an outer arm 72 which projects generally axially away from its inner arm 74. An installing and removing tool 76 includes a hollow tapered cylindrical body 78 which forms a frustoconical surface 80 which engages the ends of arms 72. As the tool 76 is moved towards the end cap assembly 22, the arms 72 are forced radially outwardly, thus pivoting the inner arms 74 radially inwardly. This causes the flyweight members 70 to be disengaged from the mounting ring 28 and allows the flyweight ring 24 and the flyweight members 70 to be axially withdrawn from or inserted into the assembly.

Figure 4:
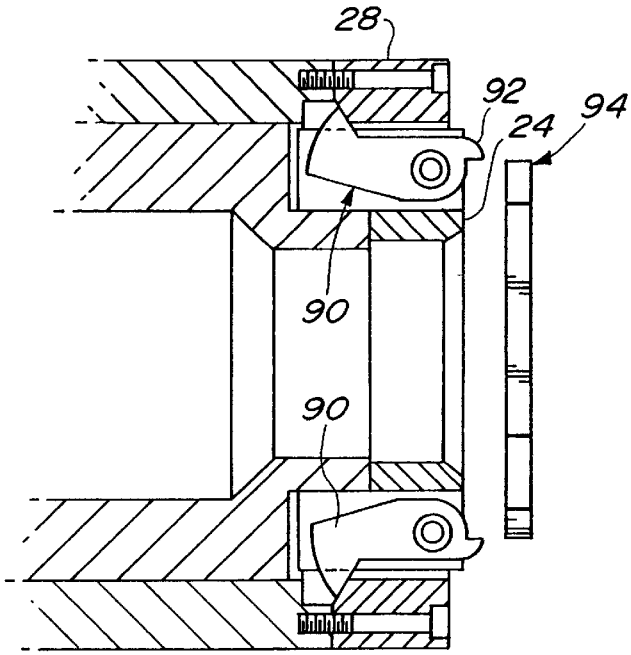
FIG. 4 is a partial sectional view of another alternate embodiment of end cap assembly together with an insertion and removal tool.
Figure 5:
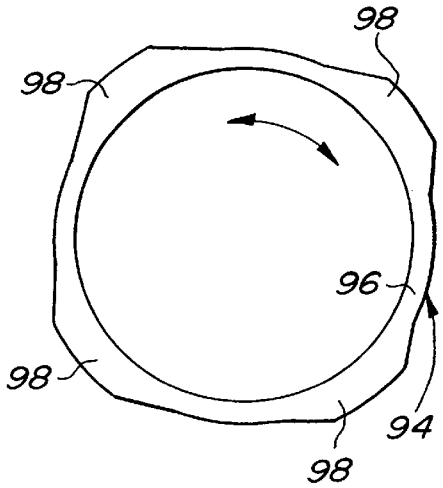
FIG. 5 is an end view of the insertion and removal tool of FIG. 4.

Alternative embodiment is shown in FIGS. 4 and 5, wherein each flyweight member 90 includes a tool engaging arm 92 for engaging a tool 94, and each flyweight member 90 cooperates with the tool to pivot out of engagement with the mounting ring 28 as the tool 94 is rotated about its central axis. The tool 94 includes a hollow cylindrical body 96 having a plurality of tabs 98 projecting radially therefrom. As the tool 94 is rotated, the tabs 98 engage and force the arms 92 radially outwardly, thus pivoting the inner part of the flyweight member 90 radially inwardly. This causes the flyweight members 90 to be disengaged from the mounting ring 28 and allows the flyweight ring 24 and the flyweight members 90 to be axially withdrawn from or inserted into the assembly.

With all the above described embodiments, as the assembly is spun, the inner ends of the flyweight members pivot radially outwardly. The flyweight members thereby cooperate with the flyweight engagement surfaces of the mounting rings to cause the flyweight rings to move axially towards the insert 16 and thereby forcing the insert against the shoulder 14.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

What is claimed is:

1. An end cap assembly for retaining an insert within a casing of a spin cast die assembly which rotates about a rotation axis, the end cap assembly, comprising:

a mounting member for attaching to an end of the casing;

a flyweight ring engaging an end of the insert; and a plurality of flyweight members pivotally mounted on the flyweight ring, the flyweight members being mounted radially internally with respect to the mounting member, the flyweight members pivoting into engagement with the mounting member when the assembly is spun and holding the insert within the casing, each flyweight member being spaced apart at all times from the insert when the assembly is being rotated, and each flyweight member operating to urge axially inwardly, in a direction parallel to said rotation axis, both the flyweight ring and the insert during rotation of the assembly.

2. The spin cast die assembly of claim 1, wherein:

a flyweight support member is received by the mounting member and the flyweight members are pivotally supported on the flyweight support member, the mounting member having a flyweight engagement surface; and each flyweight having a mounting member engagement surface formed on an arm thereof for operatively engaging the flyweight engagement surface.

3. The spin cast die assembly of claim 2, wherein:

the mounting member has an inner end for abutting against the casing, and the flyweight engagement surface faces generally radially inwardly and axially towards said inner end.

4. The spin cast die assembly of claim 2, wherein:

the flyweight engagement surface is frustoconical and faces generally radially inwardly.

5. The spin cast die assembly of claim 2, wherein:

the mounting member has an inner end for abutting against the casing, and the flyweight engagement surface faces generally radially outwardly and axially towards said inner end.

6. The spin cast die assembly of claim 1, wherein:

each flyweight member includes a tool engaging portion for engaging a tool, each flyweight member cooperating with said tool to pivot out of engagement with the mounting member as the tool is moved with respect to the mounting member.

7. The spin cast die assembly of claim 6, wherein:

each flyweight member includes an axially outer arm and an axially inner arm, the outer arm being engageable with the tool.

8. The spin cast die assembly of claim 1, wherein:

each flyweight member includes a tool engaging portion for engaging a tool, each flyweight member cooperating with said tool to pivot out of engagement with the mounting member as the tool is rotated with respect to the mounting member.

9. The spin cast die assembly of claim 1, wherein:

each flyweight member includes a tool engaging portion for engaging a tool, the tool comprising a cylindrical body having a plurality of tabs projecting outwardly therefrom, the tabs engaging the flyweight members and pivoting the flyweight members out of engagement with the mounting member upon rotation of the tool, so that the flyweight support member and the flyweight members can be axially withdrawn from or inserted into the assembly.

10. The end cap assembly of claim 1, wherein:

a flyweight support member is received by the mounting member, and the flyweight members are pivotally coupled to the flyweight support member.

11. An end cap assembly for retaining an insert within a casing of a spin cast die assembly which rotates about a rotation axis, the end cap assembly having a mounting member for attaching to an end of the casing and a plurality of flyweight members which pivot when the assembly is spun and hold the insert within the casing, characterized by:

a flyweight support member received by the mounting member, the flyweight members being pivotally supported on the flyweight support member, and the flyweight members being located radially internally with respect to the mounting member and being engagable with an internal surface of the mounting member, flyweight members urging the flyweight support member and the insert axially inwardly in a direction parallel to said rotation axis when the assembly is spun.

12. The end cap assembly of claim 11, wherein:

a portion of the mounting member forms a flyweight engagement surface; and each flyweight having a mounting member engagement surface formed on an arm thereof for operatively engaging the flyweight engagement surface.

13. The end cap assembly of claim 11, wherein:

the flyweight engagement surface extends from an outer edge radially inwardly and axially away from the shoulder to an inner edge.

14. The end cap assembly of claim 11, wherein:

the flyweight engagement surface faces generally radially inwardly and towards the shoulder.

15. The end cap assembly of claim 11, wherein:

each flyweight member includes a tool engaging portion for engaging a tool, and cooperating with said tool to pivot out of engagement with the mounting ring as the tool is moved with respect to the insert.

16. The spin cast die assembly of claim 11, wherein:

each flyweight member includes a tool engaging portion for engaging a tool, each flyweight member cooperating with said tool to pivot out of engagement with the mounting member as the tool is rotated with respect to the mounting member.

* * * * *